US007038669B2

(12) United States Patent
Myers

(10) Patent No.: US 7,038,669 B2
(45) Date of Patent: May 2, 2006

(54) SYSTEM AND METHOD FOR PROVIDING A REFERENCE VIDEO SIGNAL

(75) Inventor: Robert L. Myers, Loveland, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 265 days.

(21) Appl. No.: 10/188,194

(22) Filed: Jul. 1, 2002

(65) Prior Publication Data

US 2004/0001053 A1 Jan. 1, 2004

(51) Int. Cl.
*G09G 5/00* (2006.01)

(52) U.S. Cl. ..... 345/204; 345/205; 345/206

(58) Field of Classification Search ..... 345/352, 345/762–765, 353, 132, 114–146, 744, 202, 345/203, 204–206, 213, 3.1, 546, 545, 810, 345/699; 709/219, 217; 235/462, 462.25; 386/54; 348/193, 679, 441, 692, 180; 382/100; 313/352; 398/147; 725/110, 76; 324/76.65
See application file for complete search history.

(56) References Cited

U.S. PATENT DOCUMENTS 3,622,694 A * 11/1971 Liu ..... 348/692
3,995,105 A * 11/1976 Krivosheev et al. ..... 348/193
4,872,054 A * 10/1989 Gray et al. ..... 348/441
5,132,827 A * 7/1992 Smith et al. ..... 398/147
5,214,500 A * 5/1993 Takayama et al. ..... 348/180
5,410,363 A * 4/1995 Capen et al. ..... 348/679
5,585,691 A * 12/1996 Washburn ..... 313/452
5,682,030 A * 10/1997 Kubon ..... 235/462.25
5,898,441 A * 4/1999 Flurry ..... 345/546
6,020,901 A * 2/2000 Lavelle et al. ..... 345/545
6,195,079 B1 * 2/2001 Reddy ..... 345/3.1
6,242,900 B1 * 6/2001 Fawcett et al. ..... 324/76.65
6,253,238 B1 * 6/2001 Lauder et al. ..... 709/217
6,393,198 B1 * 5/2002 LaMacchia ..... 386/54
6,552,738 B1 * 4/2003 Lin et al. ..... 345/810
6,571,392 B1 * 5/2003 Zigmond et al. ..... 725/110
6,918,134 B1 * 7/2005 Sherlock et al. ..... 725/76
2002/0136431 A1 * 9/2002 Kimura et al. ..... 382/100
2003/0217123 A1 * 11/2003 Anderson et al. ..... 709/219
2004/0001057 A1 * 1/2004 Myers ..... 345/213
2004/0080523 A1 * 4/2004 Myers ..... 345/699

* cited by examiner

*Primary Examiner*—Vijay Shankar
*Assistant Examiner*—Prabodh Dharia
(74) *Attorney, Agent, or Firm*—Richard P. Lange

(57) ABSTRACT

A method is taught for providing a reference video signal to a video display through a video interface from a video display adapter for a host computer. The method includes the step of providing a horizontal sync line to carry a horizontal sync signal that occupies pre-defined time intervals as a representation of a horizontal sync pulse. Another step is signaling to the video display adapter that a reference amplitude pulse will be sent on a video data line. A further step is sending the reference amplitude pulse on a video data line during the pre-determined time intervals when the horizontal sync signal occupies the horizontal sync line.

27 Claims, 5 Drawing Sheets

| Pin | Definition |
|---|---|
| 1 | Red Video |
| 2 | Green Video |
| 3 | Blue Video |
| 4 | (Optional) |
| 5 | Return |
| 6 | Red Return |
| 7 | Green Return |
| 8 | Blue Return |
| 9 | DDC +5V |
| 10 | Sync Return |
| 11 | (Optional) |
| 12 | DDC Data (SDA) |
| 13 | Horizontal Sync |
| 14 | Vertical Sync |
| 15 | DDC Clk (SCL) |

FIG. 6
(PRIOR ART)

SYSTEM AND METHOD FOR PROVIDING A REFERENCE VIDEO SIGNAL

FIELD OF THE INVENTION

The present invention relates generally to providing a reference video signal.

BACKGROUND

The current analog video interface used in the personal computer (PC) industry is commonly referred to as the VGA interface and has served for over 15 years in the PC industry. This interface continues to be the de facto standard video connection and is still used with the vast majority of displays and graphics hardware sold today.

The current interface or VGA standard is based on a 15-pin high density D subminiature connector with a standardized pin-out as shown in FIG. 6. In addition, the following basic specifications are established for this system:

A. There are three video signals, providing luminance information for each of three primary color channels (Red, Green, and Blue). These are positive white signals where increasing the positive signal voltage with respect to the reference increases the luminance of that channel on the display. The signals have an amplitude of approximately 0.7V p-p, with an impedance of 75 ohms, and the signals are assumed to be AC coupled in order to block certain levels of DC voltages. The reference level for such signals are established by requiring that all three of these channels be at a defined "blanking" level during the time around the horizontal sync pulse, at which time the display will "clamp" or set an internal reference to this level. Each video signal is provided with a dedicated return line or ground.

B. In the VGA standard, timing information is not directly provided by the video signals themselves. Instead, horizontal line and vertical frame or field synchronization signals (syncs) are provided in the form of separate TTL signal lines, each on their own pin but sharing a common return.

C. Display identification and control is provided through a general purpose communications channel, established by the VESA Display Data Channel standard. This occupies pins 9, 12, and 15.

Despite its widespread use and relatively long history, this analog interface suffers from several shortcomings. One problem is its suitability for use with fixed-format displays, such as liquid crystal displays (LCDs). Another deficiency with analog interfaces is that there is generally no means of implementing an automatic gain control. There is a certain amount of signal attenuation from cable losses, circuit variations, and similar losses. This attenuation can be corrected by increasing the gain on the monitor side of the interface. Of course, users of an analog video monitor can manually adjust the gain control when such controls are provided. Even if the gain is manually adjustable, the user does not have a reference point upon which to base their adjustment. Without a reference, any modifications to the gain are merely arbitrary and the user has no idea what gain setting allows the picture to be viewed at the brightness level originally intended by the system's video adapter or graphics card.

Newer and more capable interfaces have been introduced in an attempt to address the shortcomings of the VGA interface. Two of the more widely recognized standards are the Plug & Display (P&D) standard from the Video Electronics Standards Association (VESA), and the Digital Visual Interface (DVI) standard from the Digital Display Working Group (DDWG). Both the P&D and DVI standards have offered a generally digital interface for use with non-CRT displays, under the belief that such displays are more suited to a digital form of video transmission.

These standards have seen very limited acceptance, primarily due to the lack of compatibility with the earlier VGA standard. Unfortunately, this means that display systems will generally continue to use the VGA interface despite its limitations.

SUMMARY OF THE INVENTION

The invention includes a method for providing a reference video signal to a video display through a video interface. The signal is sent to the video display from a video display adapter for a host computer. The method includes the step of providing a horizontal sync line to carry a horizontal sync signal that occupies pre-defined time intervals as a representation of a horizontal sync pulse. Another step is signaling to the video display adapter that a reference amplitude pulse will be sent on a video data line. A further step is sending the reference amplitude pulse on a video data line during the pre-determined time intervals when the horizontal sync signal occupies the horizontal sync line.

BRIEF DESCRIPTION OF THE DRAWINGS

FIG. 6 is a table illustrating the pin layout for an analog VGA video adapter.

DETAILED DESCRIPTION

Figure 1:
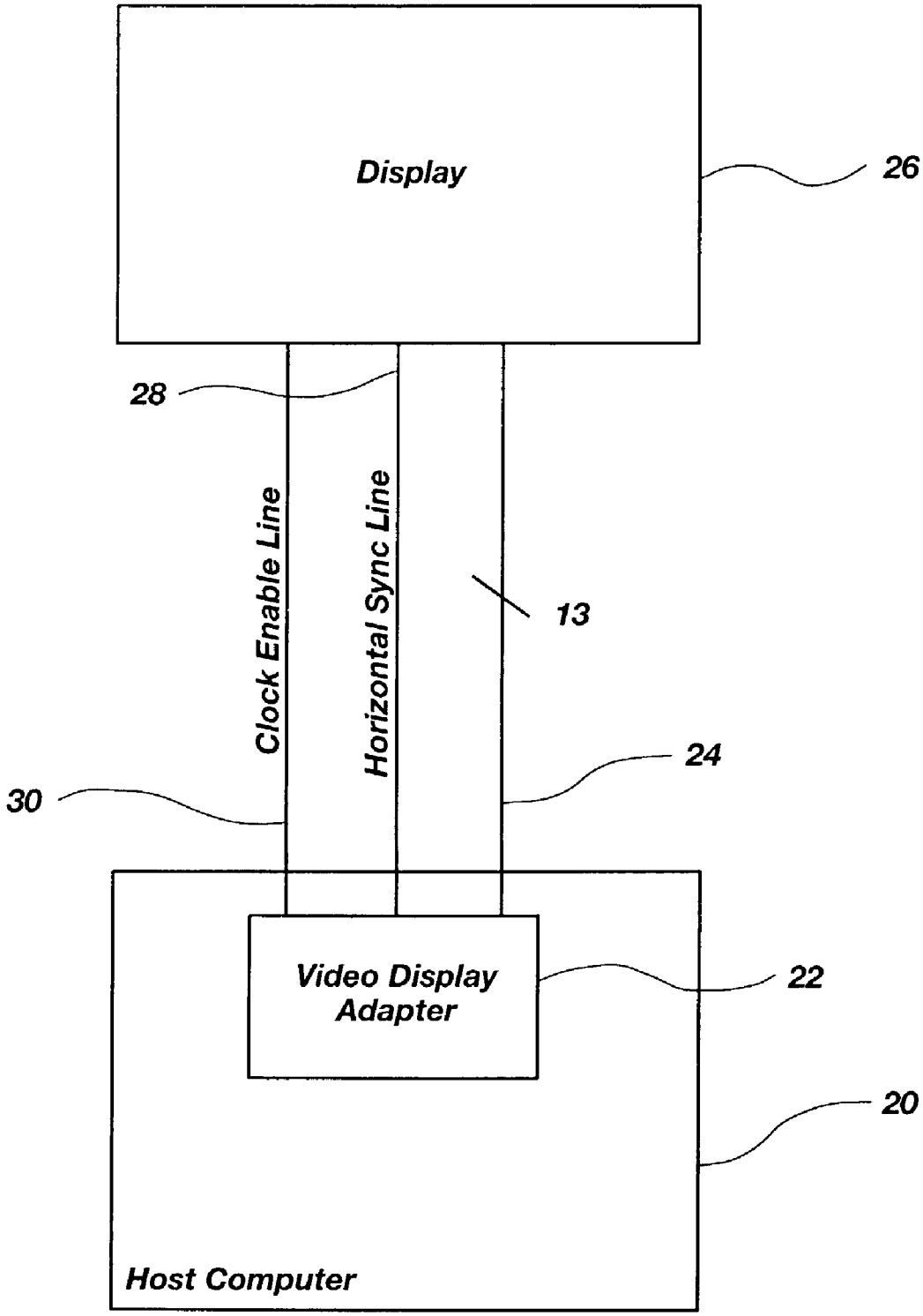
FIG. 1 is a block diagram depicting a connection between a video display adapter and a display.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

A recent trend in the computer world has been the introduction of video interface standards employing a digital transmission system. This trend is based on the belief that non-CRT display devices (such as LCDs) are "inherently digital" and are best served by a digital interface. However, this belief is not necessarily true. The majority of the popular non-CRT display technologies are distinguished from CRT displays primarily because they are fixed-format display devices not because they require digital input. This means that the display proper in such technologies provides a fixed number of physical picture elements or pixels through which the image information can be displayed to the user. These picture elements are generally arranged in horizontal rows and vertical columns.

A fixed-format arrangement does not necessarily define whether this display type is best served by digital or analog encoding of the image information. One thing that is valuable to a fixed-format display is the accurate sampling of the incoming image information. Accurate sampling allows each sample of the image data to be assigned unambiguously to the proper physical pixel of the display device.

New analog video interfaces employing different connectors have been proposed in the past, but these standards are generally incompatible with the existing VGA standard. The analog video interfaces used to date have not provided timing information to a degree finer than signaling the start of each new line. As a result, fixed-format displays supporting such interfaces have generally derived their sampling clocks from this line timing or horizontal synchronization signal (sync signal) with limited accuracy. Errors are introduced when a secondary clock is derived from the horizontal sync signal because the horizontal sync signal is unstable and contains a significant amount of noise. Even if a separate timing line is provided using additional pins in an analog video connector (e.g., VGA) it is difficult to correlate that clock input with the RGB (Red, Green, Blue) video data lines.

One embodiment of the present system and method provides a system and method for a reference video signal, which can be used for gain control. This reference video signal will be discussed as it relates to an embodiment of an analog video system capable of properly supporting fixed format display types by including a sampling clock, or a signal from which a clock may be more accurately derived. The reference video signal is capable of being used independent of the sampling clock but the sampling clock embodiment is described to illustrate that the horizontal sync pulse can still be identified within such a clocked system. This description describes the modifications to be made to the interface signals and their application within the current analog systems for fixed-format displays and/or gain control.

The modifications to these signal definitions are made so that an enhanced video display adapter or host will still be capable of driving a display that conforms to the older VGA interface without difficulty. This provides backwards compatibility along with new functionality. When an analog video display interface is discussed in this description, the specific VGA interface has been referenced. In addition to the VGA interface, other video display interfaces can be enhanced with the features and elements of the present invention.

An embodiment of the invention takes advantage of the two remaining pins defined as optional or reserved in the existing VGA definition, and uses these pins to indicate compatibility with the enhanced system. FIG. 1 illustrates that a host computer 20 can contain an analog video display adapter 22 (e.g., a graphics card) that outputs analog video signals. A display 26 is included in the system to receive and display video signals from the analog video display adapter.

Under this enhanced system, a pixel clock signal is provided by inserting a clock signal of a pre-determined pixel rate, such as 1/N of the actual display pixel clock rate onto the horizontal sync signal 28, except during the period normally occupied by the horizontal sync pulse. This pixel clock signal is sent when the display has signaled that it can accept such a clock. One way of confirming that the display can receive the enhanced signal is by grounding pin 4 in the VGA interface. This line was previously optional and is now seen by the host as CLK_ENABLE 30. If the display does not enable this pixel clock by grounding this pin, the horizontal sync pulse is transmitted under the existing VGA definition. The remainder of the video display lines 24 will continue to transfer video information. Other suitable handshake means or confirmation methods can also be devised by those skilled in the art.

Figure 2:
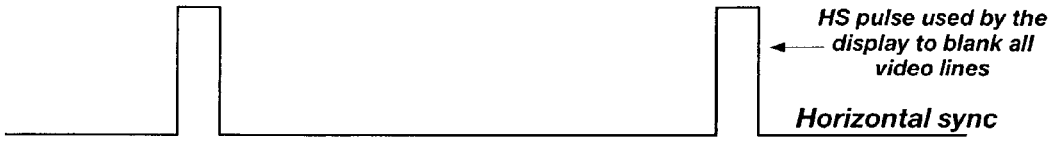
FIG. 2 illustrates the output from a horizontal sync signal line.
Figure 3:
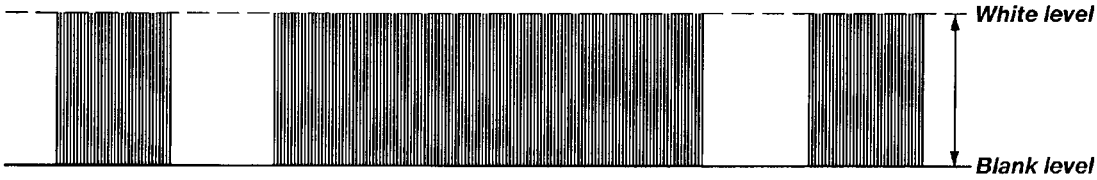
FIG. 3 illustrates an enhanced horizontal sync signal with a pixel rate clock.

FIG. 2 illustrates a wave form for a horizontal sync signal where a pulse is generated to signal the beginning of each horizontal line of pixels in the display. Illustrated directly below the horizontal sync signal in FIG. 3 is the modified horizontal sync signal with the pixel clock signal.

When the /CLK_ENABLE line is held low by the display, a 1/N rate pixel clock can be transmitted on the horizontal sync line. No signal is transmitted during the time which corresponds to the horizontal sync pulse in the existing interface definition(s). In other words, the clock is absent when the horizontal sync pulse would have been sent and the duration of this absence now defines the horizontal sync pulse for the enhanced display. Absence of the clock is defined as the lack of a transition on this line for a predetermined period with the sense of the horizontal sync pulse set by the state of the line during the horizontal sync pulse time. The host's pixel clock generator can advance the position of the horizontal sync to compensate for the delay inherent in this system. Upon receiving the predetermined number of clock transitions at the end of the horizontal sync pulse time interval, the display will know that the horizontal sync pulse has terminated.

One possible clock rate is a ⅛ rate clock which permits up to 500 MHz pixel rates to be supported with no higher than a 62.5 MHz signal on this line. The use of a ⅛ pixel clock allows the clock to be sent at a lower rate and then multiplied up on the display side. Other clock rates can be used such as ½, ¼, or 1/16, 1/32 pixel rates, or other suitable pixel clock rates.

Figure 4:
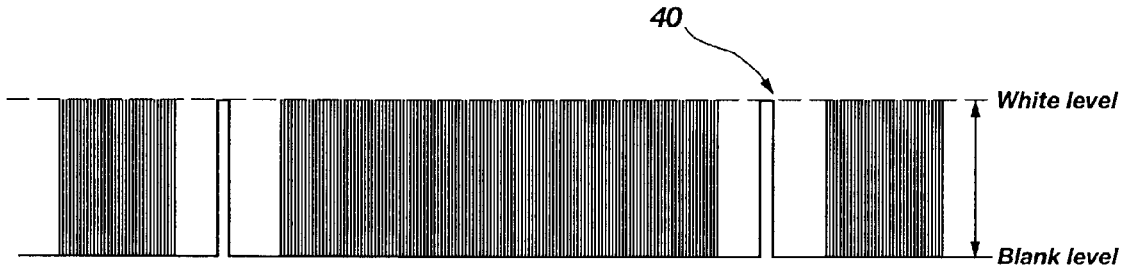
FIG. 4 depicts an enhanced horizontal sync signal with a reference video signal and a pixel rate clock.

Referring now to FIG. 4, the present invention includes a system and method for providing a reference video signal, which can be used for gain control. This is useful because the current analog interfaces do not include a means of correcting for cable losses, circuit variances, or implementing an automatic gain control. In the past, correcting for these losses was difficult because there was no guarantee that a full amplitude video signal would be provided at some point in time for an amplitude check.

One way to create a reference amplitude signal is by providing a full black to white pulse of a specified duration at the start of each active line of video data. This would permit more accurate sampling and scaling of the video information. However, video engineers who have worked with this problem in the past have realized that a full black to white pulse that is provided to existing displays would result in the appearance of an objectionable vertical white line at the left edge of the displayed image. As a result, automatic gain control has not been included in current analog video interfaces.

In order to address these problems, this present invention adds additional elements to the existing analog video interface definition to enable gain control. This gain control signal is not enabled unless the display signals compatibility with the new definition, by grounding a pin on the video connector. In the case of the VGA interface this can be pin 11, the remaining unused pin, which can be redefined as the /PULSE_ENABLE. With this pin held low by the display, the host system is permitted to provide amplitude reference pulses per the following definition and as illustrated in FIG. 4.

A positive-going pulse 40 of a pre-defined duration will be provided on each video data line during the horizontal sync pulse period. In other words, the pulse is provided on the Red, Green and Blue lines during the time when the horizontal sync pulse is sent across horizontal sync line. Sending a pulse on each video data line allows the display to compensate for different amounts of attenuation and variations on each separate line. The pulse can be generally centered within the horizontal sync pulse time interval but some variation is allowable as long as the positive-going pulse is recognizable within that time interval.

The positive-going pulse signal is preferably a full amplitude white pulse so that the maximum amplitude can be provided to the display. Generally, the use of a maximum amplitude pulse allows the display to make adjustments based on knowing the maximum signal that is being sent across the line. Other known pulse levels can be provided such a 50% or 25% pulse and then that pulse level can be used as the reference. In other words, an arbitrary pulse amount that has been pre-defined between the host and display can be used as a reference. Since the display knows in advance what the expected pulse amount should be, it can then scale the signal(s) in ratio to that known pulse. In an alternative embodiment, the pulse can be a negative-going pulse that is used as a reference signal. This negative-going embodiment has the advantage that it is not visible on the screen and does not need to be blanked by the display. The details of a negative going embodiment would be known to one skilled in the art. It is also helpful to have a pulse that is at least 16 pixels in duration, although no specific pulse length is required.

Displays using this system can use the horizontal sync pulses to blank the display, thereby rendering these amplitude reference pulses invisible to the user. The display will generate a gating or blanking pulse when the horizontal sync pulses are received. This avoids a white line as described before. A positive-going reference pulse can also be provided during the vertical blanking period. In either the horizontal or vertical cases, the pulse is outside the active video period.

Although the automatic gain control has been discussed in connection with the pixel clock, the automatic gain control can be used independently of the pixel clock. Moreover, the automatic gain control can be used with an enhanced display that is not a fixed-format display but is just a CRT display that has been modified to include the automatic gain control. In this case only one pin would be used to signal that an additional reference pulse would be sent and the pin for the pixel clock would not be used.

Figure 5:
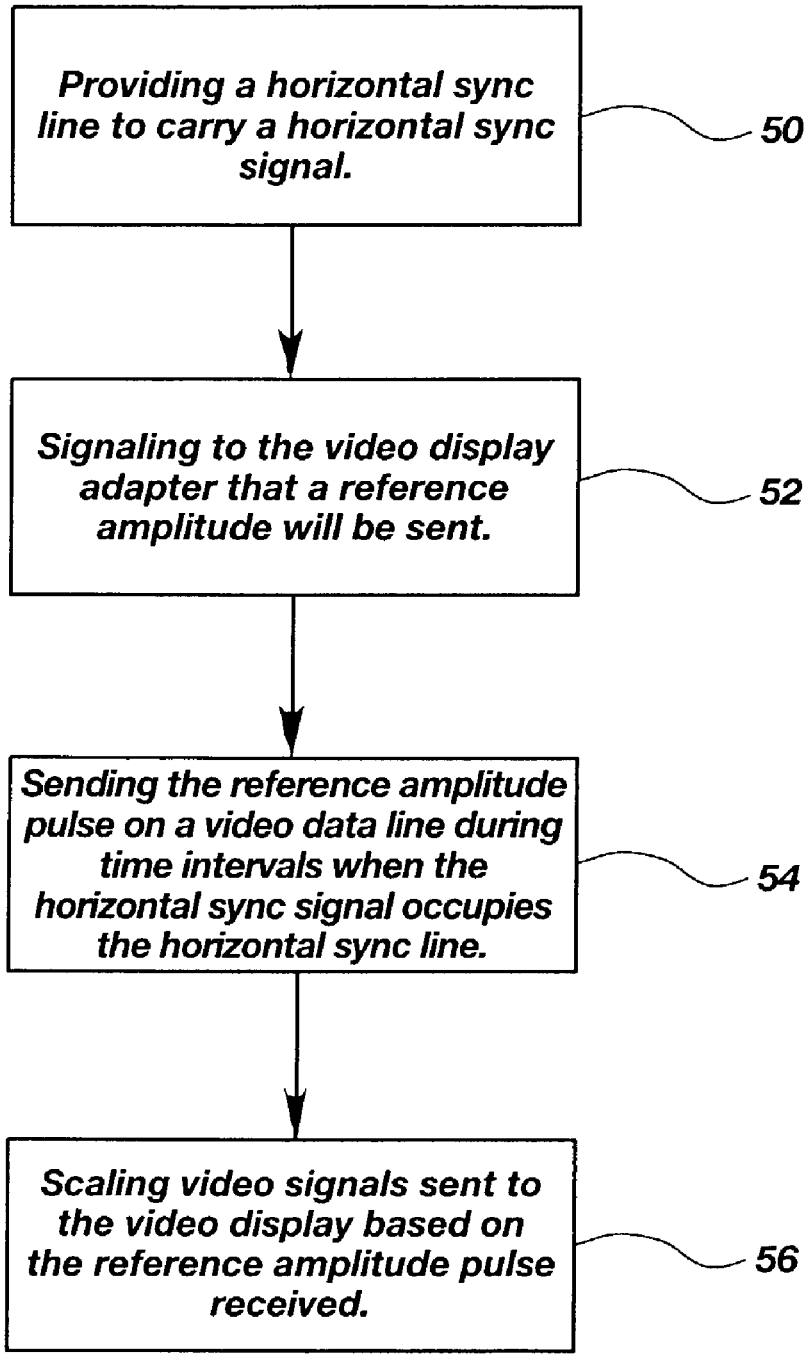
FIG. 5 is a flowchart showing steps involved in a method for providing a reference video signal.

FIG. 5 is a flowchart showing the steps in a method for providing a reference video signal to a video display. The signal is sent to the display through a video interface from a video display adapter for a host computer. The method includes the step of providing a horizontal sync line to carry a horizontal sync signal that occupies pre-defined time intervals as a representation of a horizontal sync pulse 50. Another step is signaling to the video display adapter that a reference amplitude pulse will be sent on a video data line 52. A further step is sending the reference amplitude pulse on a video data line during the time intervals when the horizontal sync signal occupies the horizontal sync line 54. Then the video sent to the video display is scaled based on the reference amplitude pulse received on the video data line 56.

This system and method can be used in other host to video display interfaces. As described above, this proposed analog interface is supportable on the existing VGA standard connection. However, the present invention can also be used with other physical interfaces and the enhanced interface can benefit from the improved electrical performance of more modem connections. Three physical connections which have generated the most current interest are the VESA Plug & Display (P&D) standard, the M1 connector standards, and the Digital Visual Interface (DVI) connector specification from the Digital Display Working Group. All three connectors are taken from the same family, employing the MicroCross™ pseudo coaxial connection for the analog video signal lines (developed by Molex Corp.). The primary difference between these standards in terms of the physical connection is the number of pins, in addition to the four pin MicroCross™ provided by each connector. The VESA connectors each provide 30 additional pin positions (organized as three rows of ten pins each), while the DDWG connector is slightly smaller, providing only 24 additional pins (3 rows of eight).

For example, the M1 definition has a sufficient number of reserved pins so as to easily redefine two to carry the /CLK_ENABLE and /PULSE_ENABLE signals from the display to the host. The DVI connector at present has no free pins, and so these flags could not be added as dedicated lines. Should it become desirable to support this enhanced video system on the DVI connector, it is recommended that these be communicated via the DDC/CI system.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth in the claims.

What is claimed is:

1. A video display system that transmits a gain control signal from a video display adapter to a video display, comprising:

a pixel clock signal configured to provide a reference at a predetermined fraction of a display pixel clock rate onto a vertical sync signal;

a clock enable line configured to enable a display to signal when the display can accept the pixel clock signal;

a vertical sync signal line, configured to transmit the pixel clock signal for a plurality of predetermined time intervals;

a vertical sync signal comprised of a null pulse on the vertical sync signal line which occurs in a vertical sync signal time between each of the plurality of predetermined time intervals of the pixel clock signal;

a video data line configured to carry video image data;

a pin in one video data line that is grounded in order to signal to the video display adapter that a gain reference amplitude pulse can be sent;

a gain reference amplitude pulse that is transmitted on the video data line during the vertical sync signal time when the vertical sync signal is occupying the vertical sync signal line.

2. A video display system as in claim 1, further comprising the step of scaling video information displayed on the video display based on the full amplitude pulse received through the video data line.

3. A video display system as in claim 1, further comprising the step of increasing gain for the video information displayed on the video display based on the full amplitude pulse received through the video data line.

4. A video display system as in claim 1, further comprising the step of sending a positive-going full-white amplitude pulse on the video data line.

5. A video display system that corrects for transmission losses on a video interface, comprising:

a video display adapter located in a host computer;

a video display, coupled to the video display adapter by a video transmission line, for displaying video information;

a vertical sync signal line in the video transmission line, having time intervals that are occupied by a vertical sync signal;

a video data line configured to carry video image data a pin in one video data line that is grounded in order to signal to the video display adapter that a gain reference amplitude pulse can be sent; and a gain reference amplitude pulse that is transmitted on the video transmission line during the time intervals when the vertical sync signal is occupying the vertical sync signal line, where the gain reference amplitude pulse allows the video display to correct for transmission losses.

6. A video display system as in claim 5 wherein the video display includes a blanking pulse so that the gain reference amplitude pulse is not viewable by a user.

7. A video display system that corrects for transmission losses on a video interface, comprising:

a video display adapter means located for interfacing with a host computer;

a video display means, coupled to the video display adapter means by a video transmission line with video data lines, and for displaying video data;

an vertical sync line in the video transmission line, configured for transmitting a vertical sync signal during pre-determined time intervals a pin means in a video data line that can be grounded for sending a signal to the video display adapter that a gain reference amplitude pulse can be sent; and a gain reference amplitude means configured for correcting transmission losses, and for transmitting on the video data line during the pre-determined time intervals when the vertical sync signal is occupying the vertical sync line.

8. A method for providing a reference video signal to a video display through a video interface from a video display adapter for a host computer, comprising the steps of:

providing a vertical sync line to carry a vertical sync signal that occupies pre-defined time intervals;

signaling to the video display adapter that a reference amplitude pulse will be sent on a video data line by grounding a pin on a video connector indicating that the reference amplitude pulse will be sent on a video data line;

sending the reference amplitude pulse on the video data line during the pre-defined time intervals when the vertical sync signal occupies the vertical sync line.

9. A method as in claim 8, wherein the step of sending the reference amplitude pulse on the video data line further comprises the step of sending a full amplitude pulse on the video data line.

10. A method as in claim 8, further comprising the step of scaling video sent to the video display based on the reference amplitude pulse received on the video data line.

11. A method as in claim 9, further comprising the step of increasing gain for video information sent to the video display based on the full amplitude pulse received on the video data line.

12. A method as in claim 9, further comprising the step of sending a positive-going full-white amplitude pulse on a video data line.

13. A method as in claim 9, further comprising the step of sending the full amplitude pulse on a video data line to an analog video display.

14. A method as in claim 8, further comprising the step of sending the reference amplitude pulse on the video data line during the pre-defined time intervals when no vertical sync signal is sent on the vertical sync pulse so that the reference amplitude pulse will not be displayed.

15. A method as in claim 8, wherein the step of sending the reference amplitude pulse further comprises the step of sending the reference amplitude pulse on the video data line centered within the pre-defined time interval for the vertical sync pulse.

16. A method as in claim 8, wherein the step of sending the reference amplitude pulse further comprises the step of sending the reference amplitude pulse of at least 16 pixels in duration on the video data line.

17. A method as in claim 8, wherein the step of sending the reference amplitude pulse further comprises the step of sending the reference amplitude pulse on a plurality of video data lines.

18. A method as in claim 17, further comprising the step of sending the reference amplitude pulse on Red, Green, and Blue video data lines.

19. A video display system that corrects for transmission losses on a video interface, comprising:

a video display adapter located in a host computer;

a video display coupled to the video display adapter by the video interface having video data lines;

a vertical sync signal line in the video interface, having time intervals that are occupied by a vertical sync signal;

a gain reference amplitude pulse that is transmitted on the video data lines during the time intervals when the vertical sync signal is occupying the vertical sync signal; and a pin of a video data line that is grounded in order to signal to the video display adapter that a gain reference amplitude pulse can be sent.

20. A video display system as in claim 19, further comprising a full amplitude pulse that is transmitted on each video data line.

21. A video display system as in claim 19, wherein the video display scales video information based on the full amplitude pulse received through the video data lines.

22. A video display system as in claim 21, wherein the video display increases gain for the video information based on the full amplitude pulse received through the vertical sync line.

23. A video display system as in claim 21, wherein the video display decreases gain for the video information where video information signal is greater in gain ratio then a pre-determined gain value to the full amplitude pulse.

24. A video display system as in claim 19, wherein the reference amplitude is sent on the video data lines during the time intervals when no signal is sent on the vertical sync pulse so that the reference amplitude pulse will not be displayed.

25. A video display system as in claim 19, wherein the reference amplitude pulse is sent on the vertical sync line and centered within the time interval for the vertical sync pulse.

26. A video display system as in claim 19, wherein the reference amplitude pulse on the vertical sync line is at least 16 pixels in duration.

27. A video display system as in claim 19, further comprising:

a clock enable signal line, associated with the video display adapter, that can be held to a low voltage by the display to signal that clock information can be sent across the video data lines; and a pixel sampling clock signal that is sent on the video data lines during time intervals that are not reserved for the vertical sync signal.

* * * * *